US005783044A

United States Patent [19]

Schneider et al.

[11] Patent Number: 5,783,044

[45] Date of Patent: Jul. 21, 1998

[54] BELT CLEANING DEVICE FOR PAPERMAKING MACHINES

[75] Inventors: Wolfgang Schneider, Stuttgart; Hans-Peter Sollinger; Karlheinz Straub, both of Heidenheim; Jürgen Banning, Dueren; Markus Oechsle, Bartholomae, all of Germany

[73] Assignee: Voith Sulzer Papiermaschinen GmbH, Germany

[21] Appl. No.: 605,545

[22] Filed: Feb. 26, 1996

[30] Foreign Application Priority Data

Feb. 24, 1995 [DE] Germany ..... 195 07 938.8
Oct. 19, 1995 [DE] Germany ..... 195 39 015.6

[51] Int. Cl.[6] ..... D21F 1/32

[52] U.S. Cl. ..... 162/278; 162/272; 162/275; 15/302; 15/309.1; 134/148; 134/199

[58] Field of Search ..... 162/272, 274, 162/275, 278, 279; 15/300.1, 302, 309.1, 345; 134/147, 148, 151, 157, 199

[56] References Cited

U.S. PATENT DOCUMENTS

| | | | |
|---|---|---|---|
| 1,540,454 | 6/1925 | Ayers . | |
| 3,966,544 | 6/1976 | Johnson | 162/199 |
| 4,047,666 | 9/1977 | Hart . | |
| 4,191,611 | 3/1980 | Rushing et al. | 162/273 |
| 5,068,513 | 11/1991 | Gangemi . | |
| 5,240,563 | 8/1993 | Karvinen et al. | 162/274 |
| 5,354,426 | 10/1994 | Rucker | 162/199 |
| 5,381,580 | 1/1995 | Gerhard et al. . | |
| 5,595,632 | 1/1997 | Macierewicz | 162/277 |

FOREIGN PATENT DOCUMENTS

| | | |
|---|---|---|
| 2102489 | 5/1994 | Canada . |
| 3150011 | 6/1994 | Canada . |
| 9412349 | 9/1994 | Canada . |
| 390042 | of 0000 | Germany . |
| 745206 | of 0000 | Germany . |
| 7929277 | 2/1980 | Germany . |
| 8703442 | 7/1987 | Germany . |
| 9014456 | 4/1992 | Germany . |
| 9208909 | 11/1992 | Germany . |
| 4322565 | 12/1993 | Germany . |
| 29503752 | 6/1995 | Germany . |
| 4419540 | 12/1995 | Germany . |
| 1458294 | 12/1976 | United Kingdom . |

OTHER PUBLICATIONS

European Office Action dated Jul. 22, 1996.

*Primary Examiner*—Peter Chin
*Assistant Examiner*—Steven B. Leavitt
*Attorney, Agent, or Firm*—Ostrolenk, Faber, Gerb & Soffen, LLP

[57] ABSTRACT

The invention relates to a device for cleaning a moving transport belt in a papermaking machine, for instance a dry or wet wire belt or a felt belt, having at least one nozzle which can be directed against the transport belt for spraying the woven belt with liquid or gaseous fluid. A suction chamber 18 surrounds and cooperates with the cleaning nozzle (8), so that dirt and/or water mist detached by the nozzle jet (27) from the transport belt (4) or residual water are drawn into the suction chamber (18) and led away, avoiding dirtying or contamination of the nearby area.

27 Claims, 7 Drawing Sheets

BELT CLEANING DEVICE FOR PAPERMAKING MACHINES

BACKGROUND OF THE INVENTION

The present invention relates to a device for cleaning a transport belt of a papermaking machine, for instance a dry or wet wire belt or a felt belt, by providing at least one nozzle which can be directed against the transport belt to blow at it air or liquid jets.

Numerous transport belts, particularly fabric belts, are used in paper machines. As part of the operation of the paper machine, these transport belts are cleaned; as meshes or pores of these belts become, for instance, clogged by paper fibers, adhesives or other substances. To assure dependable operation of the transport belt, particularly in the drying section of the paper machine, the transport belt must be kept clean. known cleaning devices of the aforementioned type (see, e.g. G 92 18 909.7 Ul) disclose the idea of providing spray nozzles which move transversely to the direction of travel of the paper, for example by being rotatable, so that the nozzle jet not only describes a linear path due to its transverse displaceability but which also produces an arcuate, wave like movement relative to the paper's linear path.

The advantage of a cleaning device developed in this manner ensues from the fact that the liquid which is sprayed onto the transport belt can be applied more uniformly and over a larger area of the transport belt. In other words, the rotatable nozzle, instead of acting on a linear region, applies a cleaning agent on a relatively wider, strip-shaped region of the transport belt. It is therefore easier to obtain and assure uniform cleaning of the entire surface of the moving transport belt.

In the known cleaning device, the transport belt, after being deflected 180°, is acted on with cleaning liquid from above, on the side opposite the web transport side. The rotatable nozzles are arranged in this connection in the region of the loop of the endless transport belt. Collecting troughs are provided below the transport belt to receive and discharge cleaning liquid and impurities from the belt. In the known device, splashing dirty water results from the liquid jet which shoots at the belt from the rotating spray nozzle. Another disadvantage is that the transport belt is left quite wet, which leads to remoistening of the paper web which contacts the moving transport belt shortly thereafter. This adversely impacts paper production, particularly the production of paper having basis weights of less than 50 g/m$^2$.

It has been suggested in the art to arrange air blasting devices behind the liquid nozzles to blow compressed air at the belt. This solution, however, has the disadvantage that it splashes water or forms a mist of water which, in turn, leads to the wetting of the paper web or the paper machine. A known steam blast device (see Federal Republic of Germany 43 22 565 A1) which has a suction device arranged on the same side of the fabric belt does not provide a satisfactory solution to the problem.

SUMMARY OF THE INVENTION

The object of the present invention is therefore to provide an improved cleaning device of the aforementioned type, which avoids the aforementioned disadvantages.

Another object of the present invention is to provide a compact and economical to make and use belt cleaning device that is also functionally reliable.

The above and other objects are realized in accordance with the invention by providing a suction space directly surrounding the cleaning nozzle so that dirt removed from the transport belt by the nozzle jet and/or water mist or remaining water can be drawn off, over the shortest possible path into the suction space and led away.

In a preferred embodiment of the cleaning device, the suction space is formed by a suction bell which surrounds the cleaning nozzle, like a shell. In this way, a compact and integral structural unit comprising a combined nozzle and suction device is obtained. The suction bell can preferably be formed of a substantially cylindrical covering over the cleaning nozzle which nozzle, in known manner, moves transversely relative to the transport belt path. Alternatively, the covering can have an elliptical or oval shape, instead of being cylindrical. In this case, the cleaning nozzle or the nozzle head should be arranged eccentrically to the cover, in a direction opposite the belt path direction, i.e. more upstream the belt path.

In a further developed preferred embodiment of the invention, the suction bell has a widening shape, in particular, a bell or cone shape which widens toward the region of its end facing the transport belt. In this way, the area of the transport belt which is covered by the suction bell or by the suction space is increased.

It has been found particularly advantageous to orient the cleaning nozzle so that it is inclined with respect to the normal to the surface of the belt. Several cleaning nozzles inclined in different directions can be provided; and they can be arranged spacedly along and traversing the suction bell. The nozzle may be of the stationary, non-rotating type. Preferably, however, at least one rotating inclined cleaning nozzle is provided since a rotating nozzle jet facilitates detaching of dirt adhering to the transport belt, as the rotation of the nozzle produces pulsed liquid jets which impinge on dust from different directions on the transport belt. It has been found that the cleaning action is most effective when and where the nozzle jet has a jet component directed opposite the direction of travel of the transport belt. The invention, therefore, includes the expedient of blocking or deactivating nozzle jet speed components directed in the direction of travel of the transport belt. To do so, a screen can be provided which prevents the nozzle jet from impinging on the belt in the direction of belt travel. Another water conserving solution provides nozzle feed lines which control fluid flow to different sections of the nozzle.

Note that, instead of a rotatable cleaning nozzle, a rotatable nozzle head having a plurality of individual nozzles can be provided, one or more of which can be developed as driving nozzles which cause the nozzle head to rotate. It is also possible to provide at least one additional nozzle, the direction of discharge of which extends away from the transport belt and therefore serves solely for producing nozzle rotation.

In order to produce a vacuum in the suction space, a compressed air injector in fluid communication with the suction space may be provided.

The inventors have also discovered that it is particularly advantageous for the opening of the suction bell facing the transport belt to be formed so as to closely match the surface contour of the transport belt or the cylindrical shape of the felt roll over which the transport belt is guided.

The best results were obtained with a cleaning device which produced water pressures of from 100 to 1000 bar. To keep the consumption of liquid as small as possible, liquid nozzles having a nozzle diameter of less then 0.3 mm were found to be highly advantageous. It was determined that nozzles made of diamond, ruby or ceramic materials were quite effective.

Other features and advantages of the present invention will become apparent from the following description of the invention which refers to the accompanying drawings.

DETAILED DESCRIPTION OF EMBODIMENTS OF THE INVENTION

Figure 1:
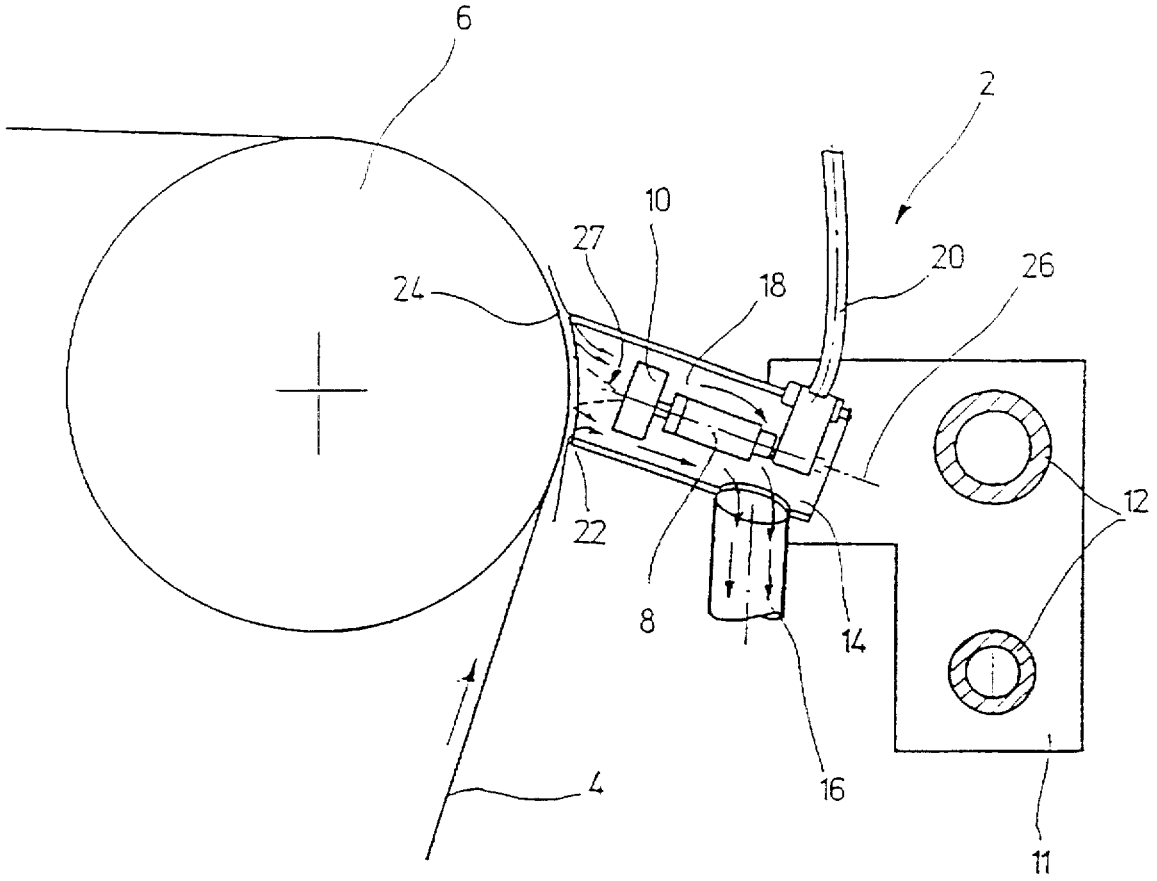
FIG. 1 shows a first embodiment of the cleaning device of the invention.

FIG. 1 shows a first embodiment of the cleaning device 2 which is arranged near a roll 6 of a paper machine to clean the drying wire or belt 4 thereof. The cleaning device 2 can be used for cleaning any desired types of transport belts of a paper or board making machine, for instance, for wire belts or felts used in the wire or forming section or the press section or the drying section of a paper machine. For ease of description, reference will be made to dryer belts of a paper machine.

The cleaning device 2 comprises a nozzle, referred to below as cleaning nozzle 8, having a rotatable nozzle head 10. The nozzle may be arranged so that it comprises one or more tangentially discharging drive nozzles which cause the nozzle to rotate at speeds of from 2000 to 3000 rpm, and further comprises one or more cleaning nozzles which spray the dryer wire 4 with a cleaning agent.

Furthermore, a cylindrical suction bell 14 surrounds the cleaning nozzle 8 and the nozzle head 10. The inside of the suction bell 14 is in fluid communication with a suction line 16, and defines a suction space or chamber 18 associated with the cleaning nozzle 8.

The cleaning facility 2 comprises a partially illustrated fluid supply including a high-pressure hose 20, which can be connected to a high-pressure pump, for supplying liquid to the cleaning nozzle 8 with a pressure in the range of from 100 to 1000 bar, preferably from 100 bar to 400 bar, and in particular from 150 bar to 300 bar. The suction line 16 serves for discharging splash water or a mist containing belt dirt from the suction space 18.

The above described cleaning device components are arranged on a traversing carriage 11 which is displaceable in a direction transverse to the direction of travel of the dryer wire 4. The traversing carriage 11 is therefore supported on transverse beams 12 and can be driven by a traversing motor (not shown) at a predeterminable speed, the traversing speed being ordinarily on the order of magnitude of about 0.3 m/min.

As can be noted from FIG. 1, an end region 22 of the suction bell 14 facing the dryer wire 4 is shaped to match the circular-cylindrical circumferential shape of the roll 6, with a given, adjustable spacing or gap being provided between the suction bell 14 and the dryer wire 4. Preferably, the spacing or gap is substantially uniform along the edge 24 of the end region 22.

Locating the cleaning device 2 near the roll 6 has the advantage that the mesh spacings of the dryer wire 4 tend to become widened, i.e. more separated, as the wire travels around the roll 6. Therefore, the cleaning medium is able to penetrate particularly easily into the weave formation of the wire and so remove impurities very effectively.

In the operation of the cleaning device 2, the cleaning nozzle 8 (or the nozzle arrangement inside the nozzle head 10) is supplied, via the high-pressure hose 20, with a cleaning fluid, preferably water under high pressure. The nozzle head 10 is then caused to rotate by reacting to the drive nozzle jets. As a result, the liquid jet describes a conical jet 27 extending at a given angle to the longitudinal axis 26 of the cleaning nozzle. Thus, the liquid jet strikes the dryer wire 4 at an angle, facilitating the removal of impurities from the wire surface.

It is also possible to equip the nozzle head 10 with one or more swingably mounted, individual nozzles which oscillate, the nozzles passing over a strip-shaped region of the dryer wire 4 during the traversing movement of the nozzle head 10.

By combining the traversely moving jets with the rotating or swinging jets, the particles of dirt are struck from different directions by the liquid jets of the nozzle arrangement, whereby they are loosened more easily than when using a nozzle which extends parallel to the centered, longitudinal line 26. Also, the fact the nozzle head or nozzle arrangement is included, results in more effective reflection or bouncing back of the liquid jet impinging on the dryer wire into the suction space 18. Thereby, the water mist which is produced can be more effectively discharged, together with the particles of dirt bound therein and residual water, via the suction line 16. A suction action or flow indicated by the arrows results. The area around the suction bell 14 is thus protected against splashing water, dirt or water seepage.

It has been found to be particularly advantageous to produce the vacuum in the suction space 18 and in the suction line 16 by means of a compressedair injector. Furthermore, it has proven advantageous to provide a facility for allowing adjusting of the vacuum in the suction space 18, so that the vacuum can be optionally set to suit different operating conditions.

Figure 2:
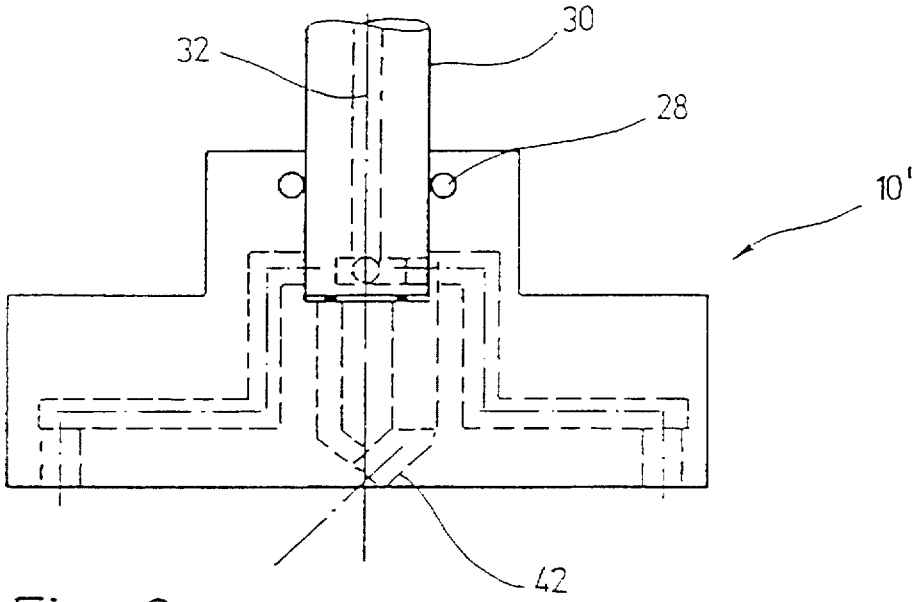
FIG. 2 is a section through a nozzle head which can be used in the device shown in FIG. 1.
Figure 3:
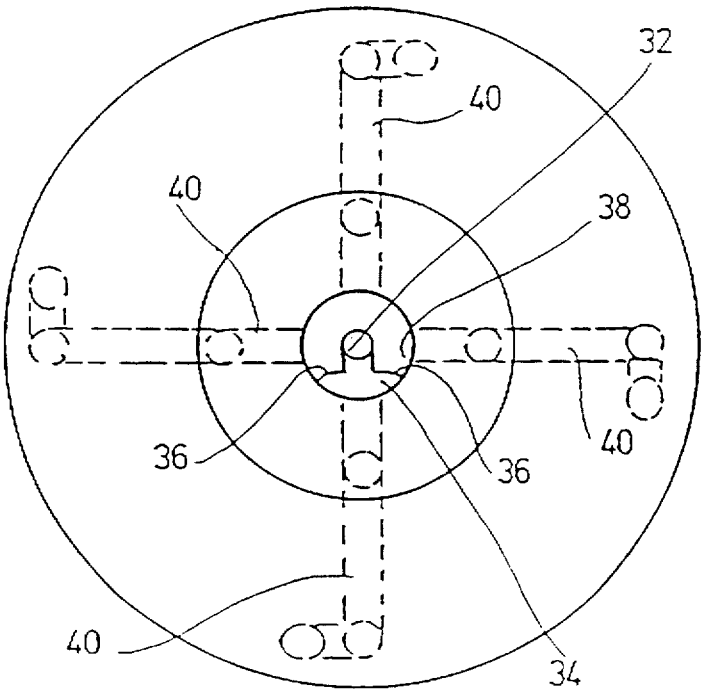
FIG. 3 is a view of the nozzle head of FIG. 2, seen from below.

FIGS. 2 and 3 show different views of a nozzle head 10', which corresponds to the rotatable nozzle head 10 of FIG. 1. The nozzle head 10' is rotatably held on a flange 30 by means of a bearing 28. Within the flange 30, there is a stationary nozzle feed line 32 which discharges into a pressurized space 34, the walls 36 of which lie in sealing but displaceable manner against the inner side of the cylindrical structural part 38. The cylindrical structural part 38 has four openings arranged 90° apart.

Figure 5:
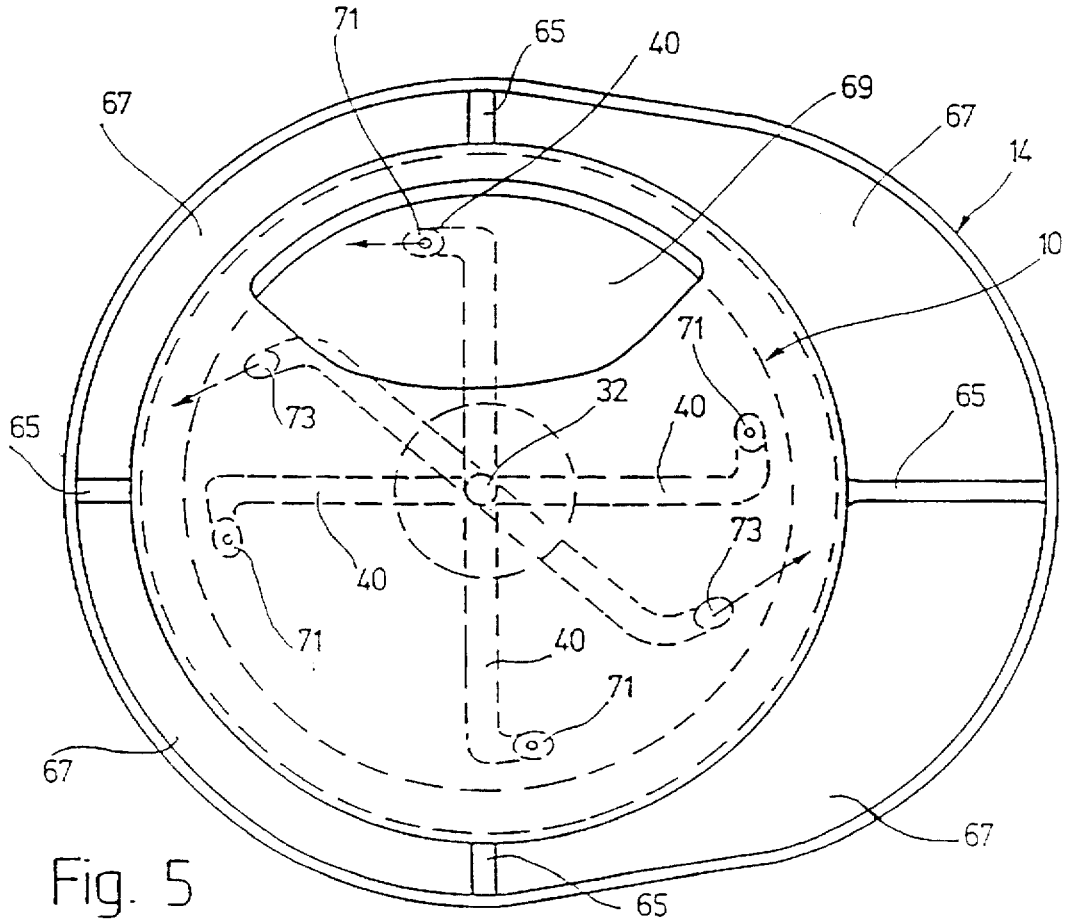
FIG. 5 is a top view of the cleaning device of FIG. 4.

Nozzle feed lines which extend radially outward are bent preferably by 90° in their end sections are connected thereto, as can be clearly seen in FIG. 5. The nozzle feed lines 40 terminate in radially bent cleaning nozzle end regions 42 (FIG. 2). The drive nozzles which are also provided are not shown.

As can also be noted in FIGS. 2 and 3, only one of the nozzle feed lines 40 is active at any time, while the other nozzle feed lines 40 are without liquid pressure. The pressurized space 14 is now so oriented that the jet of liquid has a speed component directed opposite to the direction of travel of the dryer wire 4, so that the cleaning action is highly effective. However, the nozzles whose liquid jet would have had components in the direction of travel of the dryer wire 4 are without pressure, and therefore deactivated, reducing the consumption of water.

The cleaning nozzle 8 or the individual nozzles in the nozzle head 10 are designed for a pressure range of from 100 to 1000 bar, preferably from 100 bar to 400 bar, and have a nozzle diameter of 0.1 to 0.8 mm, preferably 0.2 to 0.4 mm. Pressure values of 150 bar to 300 bar and nozzle diameters of 0.2 mm to 0.4 mm have proven particularly effective. Diamond or ruby, and preferably sapphire or ceramic materials, are good materials for making the nozzle.

Figure 4:
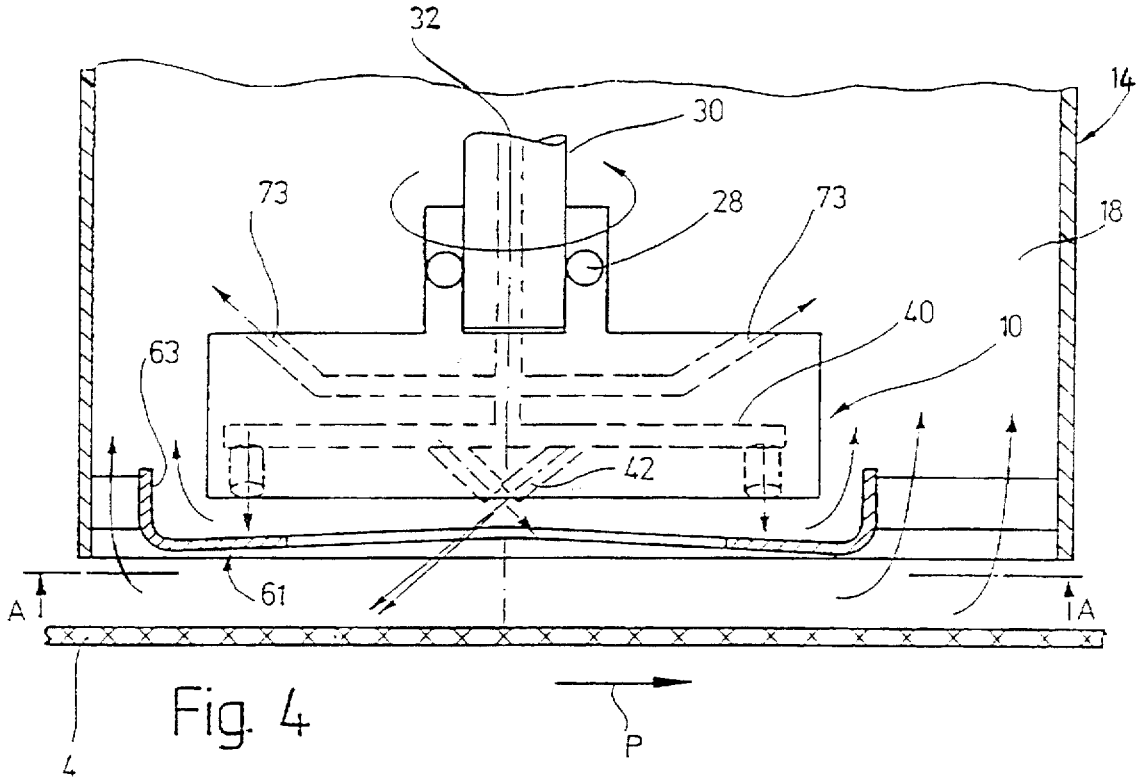
FIG. 4 is a partial section through the cleaning device of the invention in accordance with another embodiment.

A second embodiment of a cleaning device, diagrammatically shown in FIGS. 4 and 5, corresponds in its essential parts to the cleaning device described previously with reference to FIGS. 1 to 3. One difference is the oval cross-sectional shape of the suction bell 14, in which the nozzle head is arranged eccentrically, more upstream and opposite the direction of travel of the belt (arrow P). In this way, more effective suction action is exerted on the (dirt-laden) mist.

Another difference between this cleaning device and the one shown in FIG. 2 is that no pressurized space 34 is provided here. The water feed line is connected at all times with all four nozzle feed lines, as shown in FIG. 5. Thus, all four nozzle feed lines 40 simultaneously produce liquid jets.

Between nozzle head 10 and dryer wire 4 is provided a screen 61 the outermost edge 63 of which is bent as shown. This edge 63 serves as fastening rim for arms 65 which are, in turn, attached to the inner wall of the suction bell 14. Between the individual arms 65, the suction-bell wall 14 and the screen edge 63, openings or slots 67 are formed, providing a conduit from the suction space 18 to the outside.

The screen 61 has an opening 69 for the rotating nozzles 71. The dimension and position of this opening 69, particularly in the circumferential direction of the screen 61, is so selected that at least one nozzle 71 always passes through this region, the direction of the nozzle jet being opposite to the direction of travel P of the belt 4.

Thus, like the previously described function provided by the pressure space 34, only one nozzle 71 acts on the dryer wire 4 at a time. The three other nozzles shown in FIG. 5 do produce liquid jets, but these do not strike the dryer wire 4 but, rather, the screen 61. The liquid is drawn into the suction space 18, as is shown by the arrows in FIG. 4, the edge 63 of the screen 61 also serving to deflect the jets from the wire 4.

The liquid mist bouncing from the dryer wire 4 is drawn into suction space 18 either through the screen 69 or through the aforementioned slot 67.

The nozzle head 60 is driven, as in the first embodiment, by drive nozzles 73. From FIG. 4 it can be seen that these drive nozzles 70 are so arranged that the emerging fluid has an axial component of flow which is directed opposite the axial component of the liquid jet emerging from the nozzles 71. In this way, compensation for the axial recoil forces is obtained, relieving the stress on the bearing 28. The cleaning process need not be described, as it corresponds to the process described in connection with the embodiments of FIGS. 1 to 3.

Figure 6:
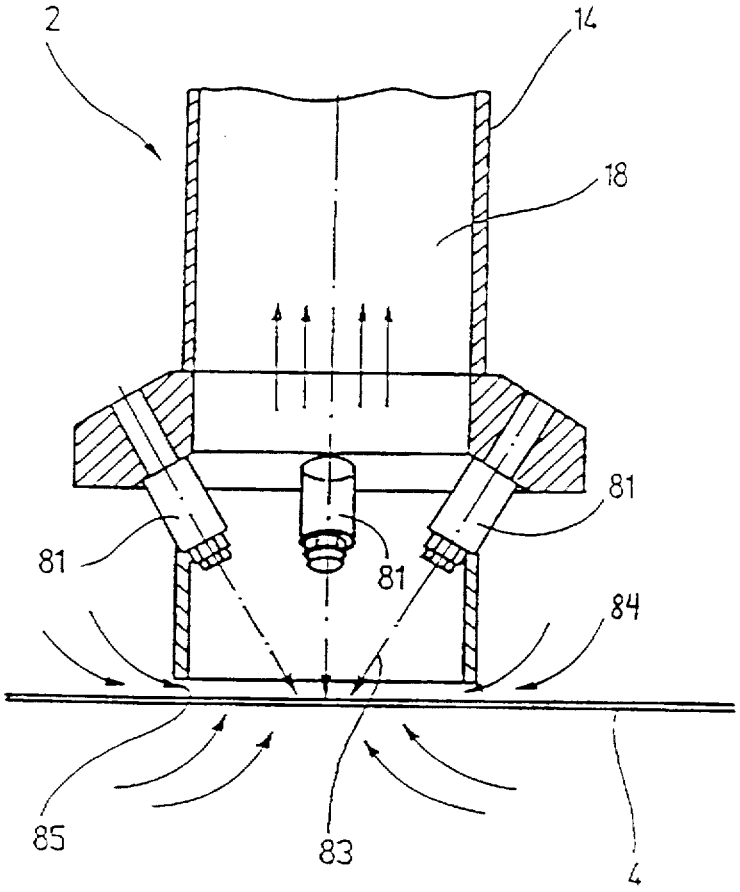
FIG. 6 is a cross section through a cleaning device in accordance with another embodiment.

FIG. 6 shows yet another embodiment of a cleaning device in which no rotating cleaning nozzles are provided. Rather, the cleaning nozzles 81 are attached rigidly to the suction bell 14. The cleaning nozzles 81 are aligned towards the center of the suction bell 14, so that the liquid jets 83 preferably meet at a point which lies opposite the opening of the suction bell 14, near or at the belt. If this jet arrangement lies in a certain way relative to the dryer wire, point impact is obtained. If the distance from the nozzles to the dryer wire changes, the point of intersection of the liquid jets also changes. The point of impact then defines an area of impact, rather than a point.

The liquid mist bouncing off the dryer wire 4 is drawn into the suction space 18, as in the preceding embodiments. The suction action is reinforced by the suction bell extending further below the nozzles 18 and terminating very close to the dryer wire. Air flows in this connection through the slot 84 formed between the suction bell 14 and the dryer wire 4, entraining the liquid mist with it.

As in the prior embodiments, the cleaning nozzles 81 are so directed that the component directed in the direction of movement of the dryer wire 4 is as small as possible. Although three cleaning nozzles are shown in FIG. 6, fewer or more than three such cleaning nozzles can be provided.

Figure 7:
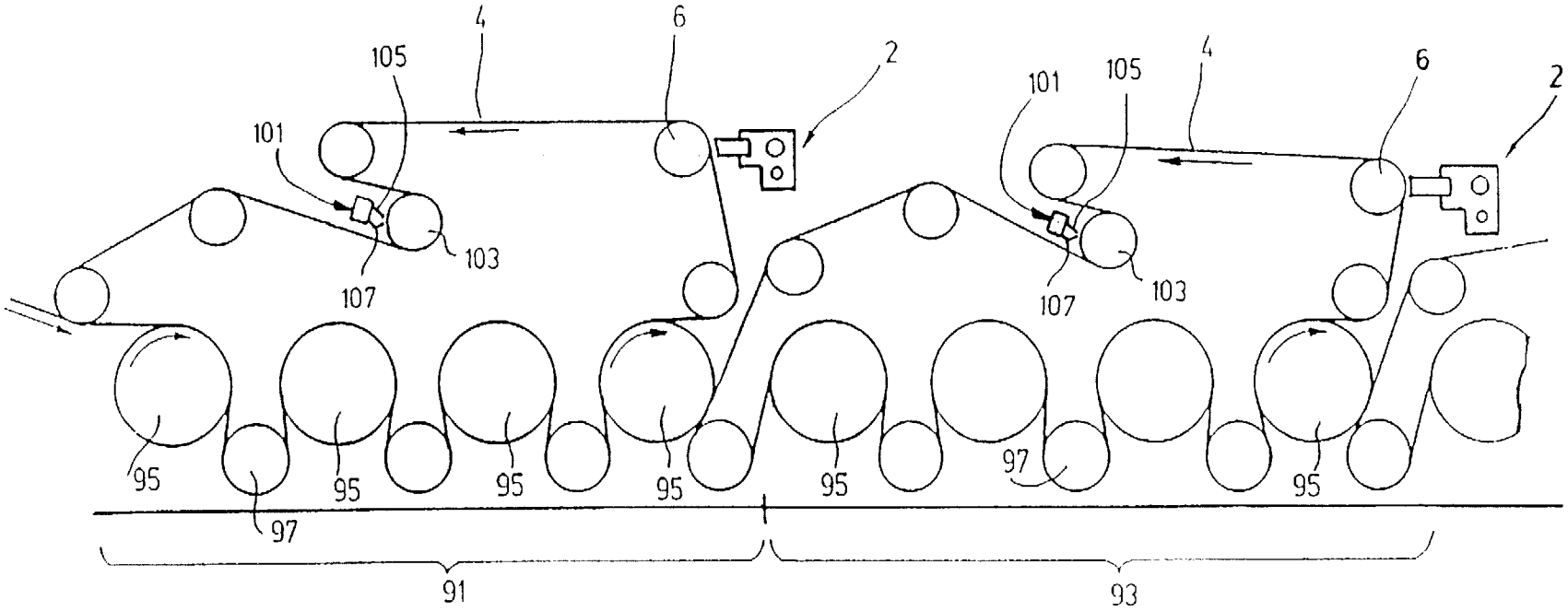
FIG. 7 depicts a drying section including the cleaning devices of the present invention.

FIG. 7 illustrates a portion of a drying section including two single-tier dryer groups 91 and 93. Each of the dryer groups 91 and 93 is formed in known manner of several drying cylinders 95 and guide rolls 97. Drying cylinders 95 and guide rolls 97 are so arranged that the web of paper is guided alternately over the drying cylinders and guide rolls and passes in meandering fashion through the dryer groups.

Each dryer group 91 and 93 has a respective dryer wire (belt, fabric, felt) 4 which, at the start of each dryer group, engages the paper web, and separates from the paper web at the end of the dryer group, traversing several felt guide rolls on its return path to the beginning of the dryer group.

As shown in FIG. 7, each dryer group 91, 93 is provided with a respective cleaning device 2 for its dryer wire 4. The two cleaning devices 2 in FIG. 7 are arranged in each case adjacent a dryer wire guide roll 6, near the start of the return path of the dryer wire 4. Therefore, leftover cleaning liquid adhering to the dryer wire 4 can evaporate before the dryer wire again contacts the paper web.

It is therefore particularly preferred that the cleaning device 2 be arranged at one of the first belt guide rolls 6, preferably the first, which is located above the last drying cylinder 95 of the dryer group 3. Because the cleaning process starts immediately after the dryer belt 4 leaves the drying cylinder 95, a relatively long time remains before the cleaned portion of dryer wire 4 reaches the beginning of the dryer group where it again contacts the paper web. The arrangement avoids remoistening of the paper web with a high degree of certainty.

The dryer wire return guide rolls 6 also play a roll in removing liquid from the dryer belt 4, due to pressure in the entry nip, i.e. the belt's initial point of contact with the roll. Furthermore, centrifugal forces act on the particles of liquid as the wire travels around the rolls 6.

The above-noted pressure in the entry nip can also be used to improve the action of the cleaning device 2. For this purpose, the cleaning device is arranged in the region of the entry nip in the manner shown, for instance, relative to the cleaning device illustrated on the left hand side of the dryer group in FIG. 7. Also note the more detailed explanation below of FIG. 8.

Figure 8:
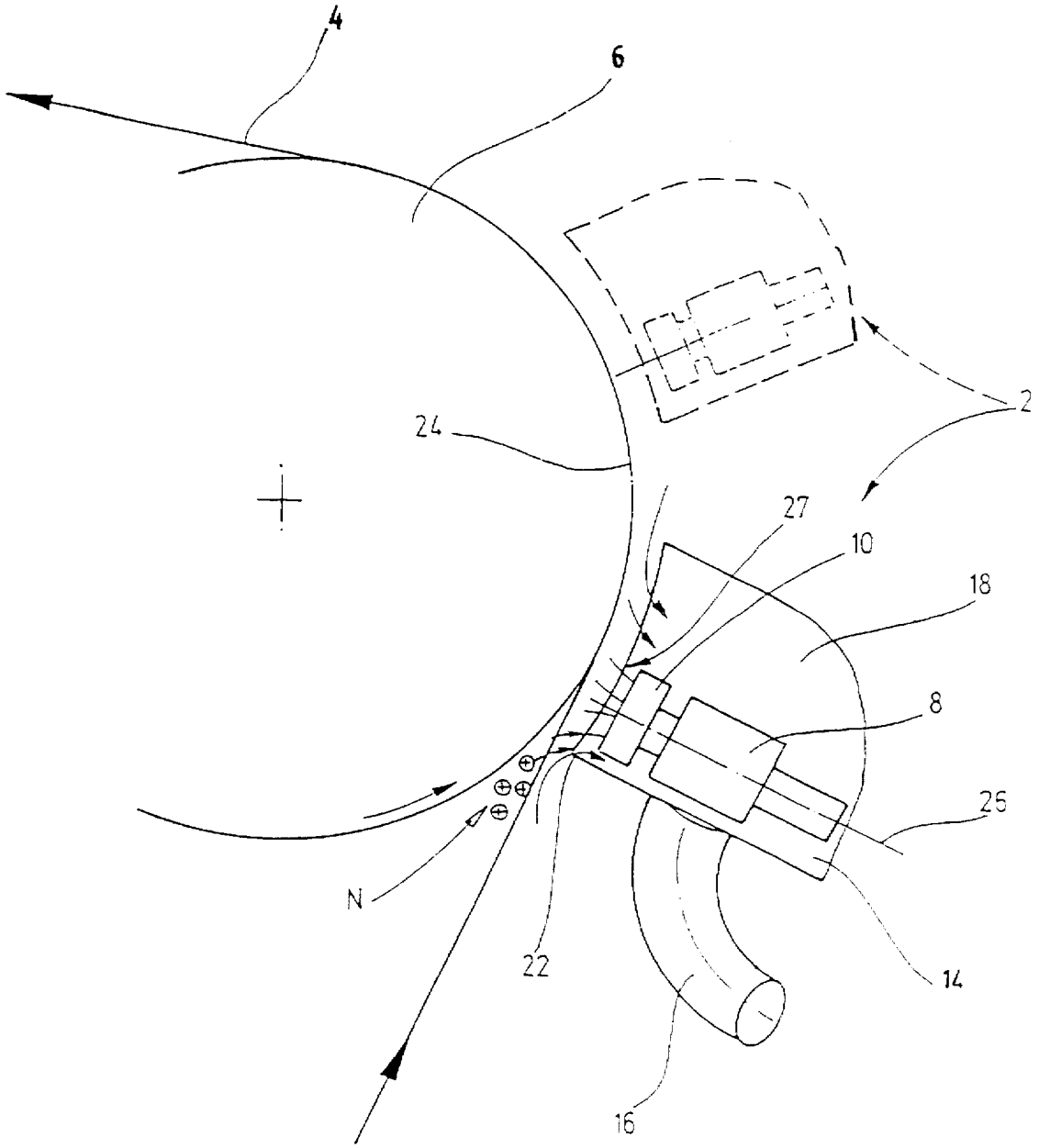
FIG. 8 illustrates the arrangement of the cleaning device opposite a guide roll of the transport belt.

That is, as shown in FIG. 8, the air entrained by the wire 4 is squeezed between the top side of the wire 4 facing the roll 6 and the surface of the roll 6. Thus, a pressure (indicated by circles containing plus signs) is produced in the entry nip N which causes a flow of air through the porous transport wire 4, which carries particles of dirt which have been detached by the cleaning device 2 into the suction chamber of the suction bell 14. This effect supports and enhances the suction action of the bell and thus the cleaning action.

The cleaning device 2 is preferably so arranged that the cleaning fluid impinges on a region of the wire 4 which is very close to touching the surface of the guide roll. Thus, it is assured that the transport wire is only slightly deformed upon the impingement of the cleaning fluid, so that the loss of energy is very slight. With such an arrangement of the cleaning device, assurance is had that the pressure in the region of the entry nip N supports the suction action of the suction space and has the result that dirt particles which have been detached are led away from the surface of the transport wire, using very little cleaning fluid.

Figure 9:
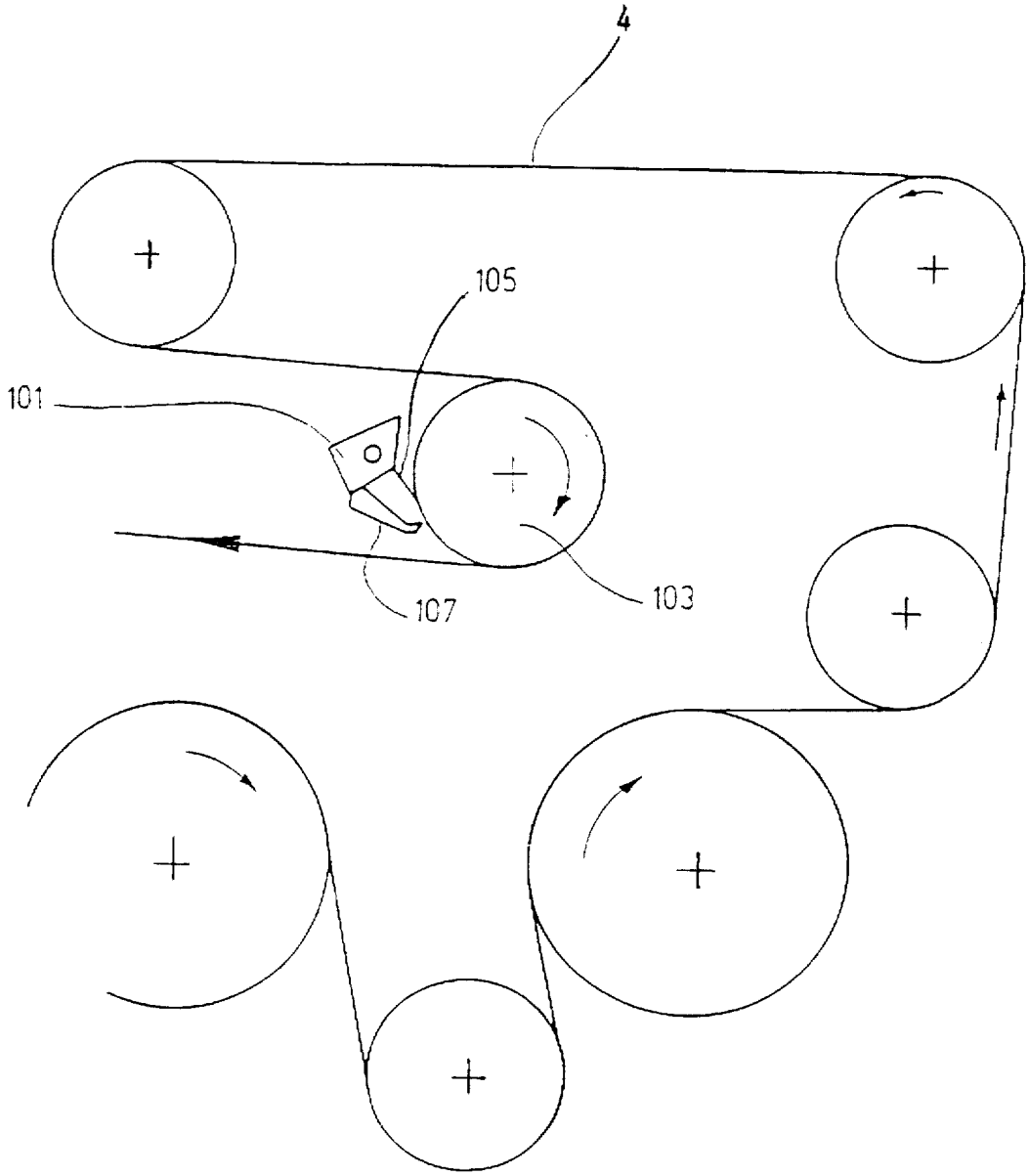
FIG. 9 shows a scraper for use in conjunction with the invention.

The cleaning device 2 may be operated and used, as can be noted from FIG. 7, in conjunction with a scraper device 101 that is arranged after the cleaning nozzles 2, downstream in the direction of movement of the dryer wire 4 or belt. The scraper 101 is located to engage the surface of a wire guide roll 103 which guides the dryer wire 4. The scraper device 101 is so arranged that—as shown in FIG. 9—particles of dirt are removed from the surface of the wire guide roll 103 by a scraper blade 105, the particles of dirt dropping into a collecting trough 107. The particles of dirt on the surface of the wire guide roll 103 are particles which while detached by the nozzle head 10 were not, however, then removed and which were then moved further with the dryer wire 4 to the dryer guide roll 103.

As described above, it is clear that the belts of the paper machine are very thoroughly cleaned by the cleaning systems described here. First, contaminant particles are very effectively removed from the surface of the transport belt by the nozzle head. Due to the high pressure of the fluid emerging from the nozzles, the particles are practically scraped off the surface of the belt. Due to the relatively small diameter of the openings in the nozzles, the amount of water required is relatively slight, as a result of which fluctuation of dirt level can be limited. The energy necessary to build up the high pressure can be reduced in the case of certain impurities, namely particles of dirt adhering only to the surface of the dryer belt. In these cases, liquid can be applied with slight pressure but in large amounts to the surface of the belt in order to wash particles of dirt off the surface.

Finally, it is also possible to adjust the amount of liquid possibly left over on the belts, by using readily evaporating liquids, so that rewetting of the paper web is avoided.

The cleaning forces can be generated both by gaseous and/or by liquid fluids. It is also conceivable to use laser and ultrasonic sources to remove impurities from the surface of the belt. The action of the cleaning device is selected depending on the material of the transport belt and of the adhering particles. As a rule, liquid is continuously fed to the nozzle head. However, it is also conceivable, in the case of corresponding surfaces or dirtying, to build up a discontinuous, for instance pulsating, streams of a cleaning fluid in order to aid the cleaning of the surface of the belt.

It is furthermore clear that the impact direction of the cleaning fluid on the wire is important for cleaning the surface of the transport belt. Also, constantly changing the direction of the cleaning flow is very advantageous to loosen the particles of dirt. This result can be obtained by means of oscillating nozzles. It is important that this cleaning action take place without traversing of the cleaning device. In that case, several cleaning or nozzle heads are arranged over the width of the dryer group to be cleaned, each being provided in each case with at least one or more individual nozzles.

Finally, it is worth noting that the cleaning action can be varied by changing the distance between the nozzle and the transport belt surface, or by changing the pressure of the cleaning fluid and/or by changing the nozzle cross section, and/or by adapting the above to different types of dirt and belt surfaces.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A device for cleaning a belt of a paper manufacturing machine, comprising:

at least one cleaning nozzle for spraying a jet of gaseous or liquid fluid on the transport belt to dislodge dirt therefrom wherein said nozzle is at an incline to the plane of the belt;

a suction chamber defined around the cleaning nozzle; and a suction device coupled to the suction chamber to cause dirt and/or water mist detached from the belt or residual water to be drawn into the suction chamber and led away, in which the cleaning nozzle includes a nozzle head including at least one outlet nozzle, each outlet nozzle having a diameter of from 0.1 mm to 0.8 mm;

including a high-pressure device coupled to and serving to supply to the cleaning nozzle pressurized fluid under a pressure range of from 100 to 1000 bar;

the suction chamber comprising a suction bell which surrounds the cleaning nozzle in the manner of a shell.

2. A device according to claim 1, in which the suction bell has a screen mounted to the bell so that the screen is disposed between the nozzle and the belt.

3. A device according to claim 1, including an end region of the suction bell which defines a belt-side opening of the suction bell, the belt-side opening being shaped to match a surface contour of the belt in a region thereof where the belt travels about a belt guide roll.

4. A device according to claim 3, in which the belt-side end region of the suction bell widens in cross section in a direction towards the belt.

5. A device according to claim 3, in which the belt-side end region of the suction bell extends over the cleaning nozzle in a direction towards the belt.

6. A device according to claim 1, in which the cleaning nozzle is rotatable around an axis.

7. A device according to claim 6, in which the rotatable cleaning nozzle is inclined relative to the axis of rotation.

8. A device according to claim 7, including a plurality of individually controllable nozzle feed lines for supplying fluid to different sections of the cleaning nozzle.

9. A device according to claim 6, in which fluid jets of the cleaning nozzle capable of flowing in a direction of travel of the belt are blocked.

10. A device according to claim 1, the cleaning nozzle including a rotatable nozzle head having several outlet nozzles.

11. A device according to claim 1, in which the suction chamber has a cross section that is generally oval or elliptical.

12. A device according to claim 11, in which a major axis of the cross section of the suction chamber extends in the direction of travel of the belt, and in which the cleaning nozzle is arranged eccentrically, off-center relative to the vacuum chamber and more upstream relative to the direction of travel of the belt.

13. A device according to claim 1, in which the cleaning nozzle is arranged adjacent an entry nip region of the belt on a guide roll.

14. A device according to claim 1, in which the cleaning nozzle is arranged following the last drying cylinder of a dryer group, on a return path of the belt.

15. A device according to claim 1, in which the pressure range is from 100 to 400 bar.

16. A device according to claim 1, in which the diameter is in the range of from 0.2 to 0.4 mm.

17. A device for cleaning a belt of a paper manufacturing machine, comprising:

at least one cleaning nozzle for spraying a jet of gaseous or liquid fluid on the transport belt to dislodge dirt therefrom wherein said nozzle is at an incline to the plane of the belt;

a suction chamber defined around the cleaning nozzle; a suction device coupled to the suction chamber to cause dirt and/or water mist detached from the belt or residual water to be drawn into the suction chamber and led away;

in which the cleaning nozzle is rotatable around an axis, and including a screen for blocking portions of the cleaning nozzle which produce fluid speed components of the cleaning nozzle directed in a direction of travel of the belt.

18. A device for cleaning a belt of a paper manufacturing machine, comprising:

at least one cleaning nozzle for spraying a jet of gaseous or liquid fluid on the transport belt to dislodge dirt therefrom wherein said nozzle is at an incline to the plane of the belt;

a suction chamber defined around the cleaning nozzle; and a suction device coupled to the suction chamber to cause dirt and/or water mist detached from the belt or residual water to be drawn into the suction chamber and led away, in which the cleaning nozzle is adiustably mounted to produce an oscillating movement.

19. A device for cleaning a belt of a paper manufacturing machine, comprising:

at least one cleaning nozzle for spraying a jet of gaseous or liquid fluid on the belt to dislodge dirt therefrom wherein said nozzle is at an incline to the plane of the belt;

a suction chamber defined around the cleaning nozzle; a suction device coupled to the suction chamber to cause dirt and/or water mist detached from the belt or residual water to be drawn into the suction chamber and led away; and including a scraper device for enhancing cleaning of the belt by scraping off belt contaminants.

20. A device according to claim 19, in which the scraper device is arranged adjacent a belt guide roll which is located further down, relative to the cleaning nozzle, along a direction of travel of the belt.

21. A device according to claim 20, in which the scraper device is located so that it engages the surface of the belt guide roll.

22. A device according to claim 20, in which the belt guide roll is arranged to contact that surface of the belt which has been cleaned by the cleaning nozzle.

23. A device according to claim 19, in which the scraper device includes a scraper for scraping contaminants off the belt guide roll and a collecting trough which receives the contaminants.

24. A device according to claim 19, in which the belt guide roll is arranged in a return path of the belt in a dryer group.

25. A device for cleaning a transport belt of a paper manufacturing machine, comprising:

at least one cleaning nozzle for spraying a jet of gaseous or liquid fluid on the transport belt to dislodge dirt therefrom wherein said nozzle is at an incline to the plane of the belt;

a suction chamber defined around the cleaning nozzle; and a suction device coupled to the suction chamber to cause dirt and/or water mist detached from the belt or residual water to be drawn into the suction chamber and led away.

26. A device according to claim 25, in which the device includes an ultrasonic and/or light source.

27. A device for cleaning a conveyor belt, a dry-end or web-end wire belt or a felt belt in a papermaking machine, with at least one nozzle that is aimed at an incline to the plane of the belt in order to subject it to a gaseous or liquid medium and with a suction space that operates in conjunction with the nozzle, characterized in that the suction space (18) which consists of a suction bell (14) that encloses the nozzle (8) like a jacket, is associated with the nozzle such that any dirt, water vapor, or residual water released from the belt (4) by the jet (27) leaving the nozzle can be sucked into the suction space and removed, the nozzle being subjected to a medium compressed to 100 to 1000 bars, and the cleaning device (2) being located in the vicinity of a roller (6).

* * * * *